United States Patent [19]

Ottaviano

[11] Patent Number: 4,557,716

[45] Date of Patent: Dec. 10, 1985

[54] MECHANISM FOR PRODUCING PAD-LIKE CUSHIONING DUNNAGE FROM SHEET MATERIAL

[75] Inventor: Gary W. Ottaviano, Bedford Heights, Ohio

[73] Assignee: Ranpak Corp., Willoughby, Ohio

[21] Appl. No.: 510,671

[22] Filed: Jul. 5, 1983

[51] Int. Cl.[4] ..... B31F 1/10; B65H 19/30

[52] U.S. Cl. ..... 493/464; 493/967; 242/58.6

[58] Field of Search ..... 242/58.6, 79; 493/464, 493/967; 403/13, 14

[56] References Cited

U.S. PATENT DOCUMENTS

| | | | |
|---|---|---|---|
| 510,346 | 12/1893 | Keist | 242/60 |
| 2,721,709 | 10/1955 | Auerbacher | 242/58.6 |
| 3,069,107 | 12/1962 | Hirt | 242/58.6 |
| 3,089,716 | 5/1963 | Berkowitz | 403/13 |
| 3,606,410 | 9/1971 | Inserra | 403/13 |
| 4,026,198 | 5/1977 | Ottaviano | 493/464 |

FOREIGN PATENT DOCUMENTS 822769 10/1951 Fed. Rep. of Germany ..... 242/58.6

*Primary Examiner*—Francis S. Husar
*Assistant Examiner*—William E. Terrell
*Attorney, Agent, or Firm*—Baldwin, Egan & Fetzer

[57] ABSTRACT

A mechanism for producing low density pad-like resilient cushioning dunnage product from sheet-like stock material, such as for instance paper, comprising a support for rotatably mounting a roll of sheet-like stock material in operative condition thereon, and projections on the support adapted for coupling with receptacle structure defining recesses on a separable mobile cart, for detachably coupling the cart to the mechanism, with the cart having mounts thereon for rotatably mounting a roll of sheet-like stock material and in position for feeding the stock material into the dunnage producing mechanism, when the latter and the cart are in coupled condition, to create the pad-like cushioning dunnage product.

12 Claims, 11 Drawing Figures

MECHANISM FOR PRODUCING PAD-LIKE CUSHIONING DUNNAGE FROM SHEET MATERIAL

This invention relates in general to a mechanism for producing packing material or cushioning dunnage, as it is known in the art, and more particularly to a dunnage producing mechanism for the production of a continuous resilient pad-like dunnage product from sheet-like stock material disposed in roll form, normally mounted on the mechanism, and in combination with a mobile cart useable in conjunction with the dunnage producing mechanism, for supporting a roll of stock material on the cart, and with means on the cart and on the dunnage producing mechanism, for detachably coupling the cart and mechanism together during use of the cart for furnishing the sheet stock material to the dunnage producing mechanism.

The invention provides an arrangement for the possibility of supporting a larger and heavier roll of stock material in operative position for use by the dunnage producing mechanism as compared to the conventional arrangement of mounting the stock roll on the dunnage producing mechanism per se.

BACKGROUND OF THE INVENTION

In applicant's U.S. Pat. No. 4,026,198 dated May 31, 1977, and entitled "Cushioning Dunnage Mechanism, Transfer Cart Therefor and Method" there is disclosed a cushioning dunnage producing mechanism of the general type utilized in the present invention, for producing pad-like cushioning dunnage product.

In such prior art mechanism, the stock roll is adapted to be conventionally mounted directly on the dunnage producing mechanism and the sheet material thereof is pulled off the stock roll and fed into the mechanism upon operation thereof. The size (and weight) of the stock roll that is able to be mounted on the dunnage producing mechanism is generally limited, due in part to the desire to maintain the maximum peripheral extremity of the mounted stock roll substantially no lower than a horizontal longitudinal plane passing through the inner defining surface of the chute of the dunnage producing mechanism at the entrance to the chute, in the interests of optimum operation of the mechanism, and production of the cushioning dunnage pad product without problems occurring in the sheet stock as it is fed from the stock roll into the mechanism.

SUMMARY OF THE INVENTION

The present invention provides a dunnage producing mechanism of the general aforedescribed type which has means thereon adapted to couple the mechanism to a mobile cart which is capable of supporting a somewhat larger stock roll of material thereon, and to position the stock roll in operative position with respect to the dunnage producing mechanism, so as to be in position to effectively feed the sheet-like stock from the stock roll for passage into the mechanism, and thence to be formed by the mechanism into a resilient pad-like cushioning product. The mobility of the cart aids in providing for the convenient location of the stock roll in operative condition with respect to the dunnage producing mechanism, and yet the cart mechanism can be readily coupled to and uncoupled from the dunnage producing mechanism per se.

Accordingly, an object of the invention is to provide a novel dunnage producing mechanism having means thereon which enables the mechanism to be readily coupled to and uncoupled from an associated stock supporting cart.

Another object of the invention is to provide a mechanism of the above type wherein a larger and heavier roll of stock material can be associated with the dunnage producing mechanism as compared to the heretofore utilized size of stock roll, and wherein the location of the commencement of feeding of the sheet-like stock material into the dunnage producing mechanism will not vary as the stock roll is used but instead is maintained at a constant point of entry of the sheet-like stock material toward the separating means of the dunnage producing mechanism, resulting in a more uniform and effective production of the pad-like dunnage product.

A still further object of the invention is to provide a mechanism of the aforediscussed type wherein the means for coupling the dunnage producing mechanism to the stock roll support cart comprises coacting male and female structure which when coupled together properly and effectively positions the stock roll support cart with respect to the dunnage producing mechanism so that the removal of the stock sheet material from the stock roll on the cart and the feeding thereof into the dunnage producing mechanism per se is optimumly accomplished.

A still further object of the invention is to provide a stock roll support cart which is adapted for utilization with a compact dunnage producing mechanism, to produce a resilient pad-like cushioning dunnage product, and wherein such stock roll support cart enables utilization of a stock roll of larger size and heavier weight as compared to stock rolls heretofore utilized on the dunnage producing mechanism per se, thus providing for more uninterrupted production of the dunnage product without necessitating as often a replacement of the stock roll.

Other objects and advantages of the invention will be apparent from the following description taken in conjunction with the accompanying drawings.

BRIEF DESCRIPTION OF THE DRAWINGS

FIG. 9 is an enlarged, fragmentary, side elevational view of one of the coupling receptacles on the stock roll support cart of FIGS. 5 through 8, for receiving therein the projecting coupling means on the dunnage producing mechanism, to couple the stock roll support cart to the dunnage producing mechanism, and as illustrated in FIG. 1.

DESCRIPTION OF PREFERRED EMBODIMENT

Figure 1:
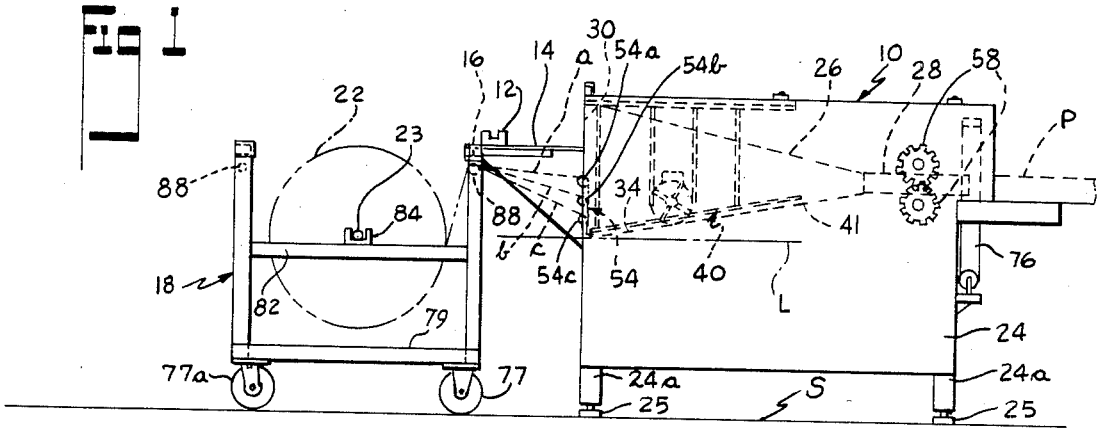
FIG. 1 is a generally diagrammatic side elevational view of a dunnage producing mechanism and the mobile stock roll support cart disposed in coupled, operative position, for furnishing sheet stock material to the dunnage producing mechanism in the production of resilient pad-like cushioning dunnage product.

Referring now again to the drawings, there is illustrated a dunnage producing machine 10 which is adapted to utilize a multi-ply stock roll of sheet-like material, such as for instance kraft paper thereon, and as illustrated in the aforementioned U.S. Pat. No. 4,026,198. The roll of stock material is adapted to be rotatably mounted on a supporting rod extending through the roll of stock material, which in turn is adapted to be mounted at its ends onto the spaced brackets 12 which are supported on the spaced, cantilevered support plate structures 14 extending laterally of the entranceway 15 to the dunnage producing mechanism, and as shown in FIG. 1 and in the aforementioned prior art U.S. Pat. No. 4,026,198, which is incorporated herein by reference.

Figure 3:
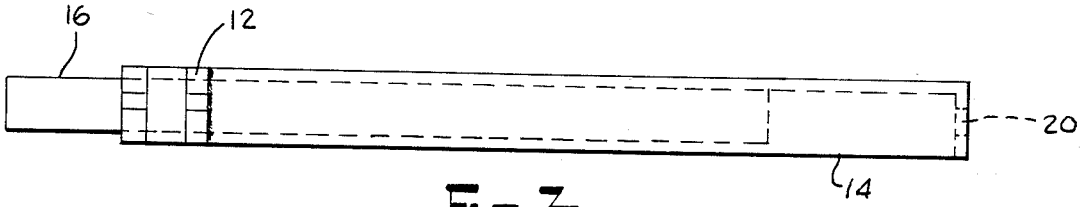
FIG. 3 is a top plan view of the support plate structure illustrated in FIG. 2.
Figure 2:
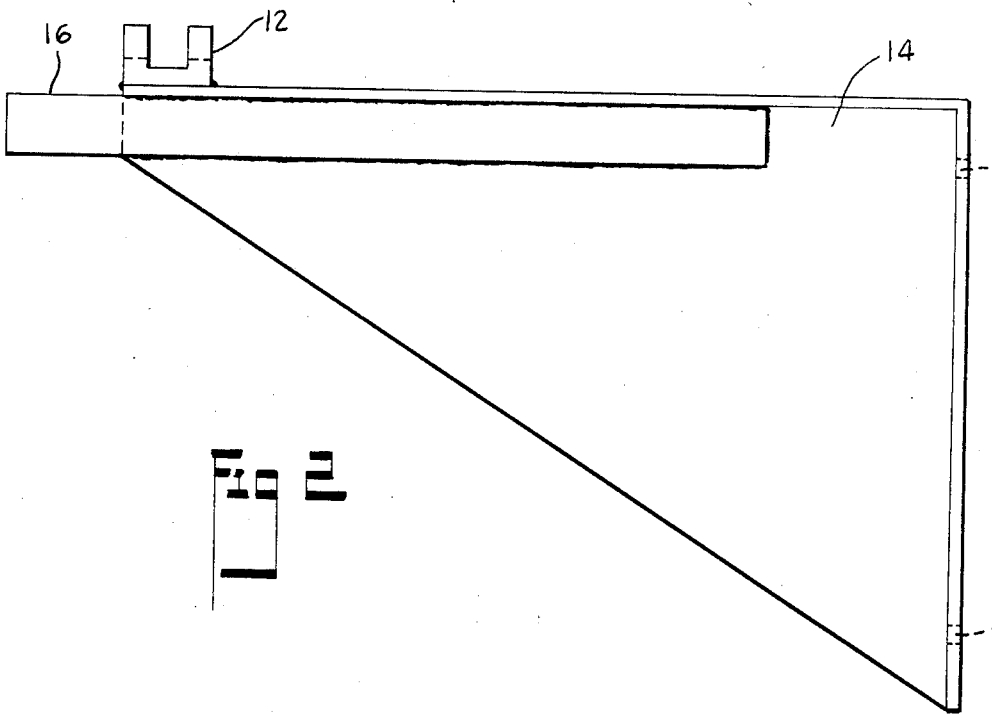
FIG. 2 is an enlarged, side elevational view of one of the cantilever support plate structures which is arranged for mounting thereon a stock roll on sheet-like stock material, when the stock roll is mounted directly onto the dunnage producing mechanism, for furnishing the sheet stock to the mechanism in the production of resilient pad-like cushioning dunnage product, and with the support plate structure embodying coupling means for coupling the dunnage producing mechanism to the mobile stock roll support cart, as shown in FIG. 1.
Figure 4:
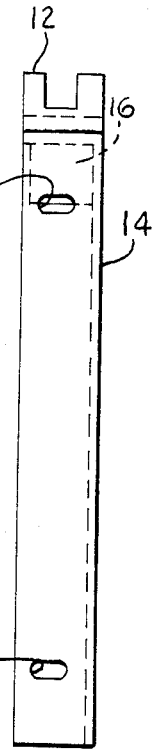
FIG. 4 is an end elevational view of the support plate structure of FIGS. 2 and 3 taken generally from the righthand end of FIG. 2.

The support plate structure 14 in this embodiment of dunnage producing mechanism may be generally similar to those shown in the aforementioned U.S. Pat. No. 4,026,198 with the addition thereto, however, of coupling means 16 in the form of a generally fixed projection, in this embodiment, extending laterally of the aforementioned stock support brackets 12, and adapted for coupling with generally fixed coupling means on the stock roll support cart 18, as will be hereinafter described in greater detail. Support plate structure 14 preferably has elongated slots 20 formed therein as best shown in FIGS. 2, 3 and 4, for providing for a certain amount of adjustment of the position of the support plate on the main frame of the cushioning dunnage producing machine 10, as will be hereinafter described in greater detail.

In the embodiment illustrated, the stock roll 22 furnishing the sheet material for the dunnage producing machine, is comprised of three superimposed webs of sheet material (e.g. kraft paper) and is preferred, but could be comprised of a single web, or a lesser plurality or a greater plurality of webs of sheet stock, which are preferably of generally equal width. One end of the aforementioned rod 23 extending through the stock roll is adapted to have an opening therethrough receiving a transverse pin (not shown) projecting laterally from the rod for preventing rotation of the rod upon rotation of the roll about the rod. In other words, the roll of stock material frictionally rotates relative to its supporting rod during pulling of the sheet stock material into the dunnage producing mechanism 10 and in the general manner described in conjunction with the arrangement shown in prior art U.S. Pat. No. 4,026,198.

Machine 10 comprises, in the embodiment illustrated, a main support frame 24 including leg portions **24*a* which preferably include means 25** associated therewith, for leveling the machine frame with respect to the supporting surface S.

Frame 24 supports a longitudinally converging chute 26 which forms a guide and support for the webs a, b and c of stock material drawn off the stock roll 22 as they pass through the mechanism. From the stock roll, the webs a, b and c move through the chute 26, after which they pass to a longitudinally elongated crumpler section 28 of the dunnage producing machine, and in the general manner described in aforementioned U.S. Pat. No. 4,026,198.

The chute section 26 in the embodiment illustrated comprises a widened entrance mouth or entranceway portion 30 of generally oval shape with the major axis of the oval shape disposed in a generally horizontal plane which passes in general through the horizontal center plane of the crumpler section 28.

A pusher mechanism 40 of the general type of aforementioned U.S. Pat. No. 4,026,198 extends downwardly into the chute section 26 into closely spaced relation to the inner surface 34 of the bottom wall 41 of the chute. Reference may be had to aforementioned U.S. Pat. No. 4,026,198 for a more detailed disclosure of suitable pusher mechanism.

Mounted on the main frame 24 downstream from the stock roll mounting lugs 12 is a separating means 54, which in the embodiment illustrated comprises a plurality (and in the embodiment illustrated three) of vertically spaced generally horizontally oriented bar-like elements **54*a*, 54*b* and 54*c* about which is adapted to pass the webs a, b and c of the stock material from rotatable stock roll 22. As can be seen from FIG. 1, the upper web a of stock material is adapted to pass over separator rod 54*a*, while the middle web b passes over separator rod 54*b*, and the lower web c passes over the lower separator rod 54*c*. The separator mechanism maintains the webs in separated condition prior to their being urged back into generally juxtaposed condition at the pusher mechanism 40, the latter being downstream from the preferably cylindrical (in cross section) separator rods. As can be seen from FIG. 1, the lowermost rod 54*c* is disposed just slightly above the bottom periphery of the entranceway to chute section 26, and with sufficient clearance so as to permit ready entry of the stock web c from the separator rod 54*c* to pass beneath the pusher mechanism 40**.

The crumpler section 28 preferably has slots in its upper and lower walls into which extend connecting or stitching means 58 for connecting confronting portions of the generally loosely crumpled stock material together, as the latter is drawn through the crumpler section by the connecting means 58. In this connection, the connecting means comprises generally loosely meshed spur gear-like elements which are rotatably mounted as by means of a respective shaft, for rotation relative to the crumpler section 28. The stitching or connecting gear means are operatively coupled to a prime mover, such as for instance an electric motor mounted on the machine frame, and the actuation of such motor will cause rotation of the meshed gear means, thus not only coining or connecting the stock material by rotation of the gears, but also pulling the crumpled stock material through the mechanism, after which the pad-like cushioning product P is emitted from the discharge end of the machine where it can be cut into selected lengths as by means of cutter mechanism 76 mounted on the rear end of the machine. Reference may be had to aforementioned prior art U.S. Pat. No. 4,026,198 for a more detailed discussion of a structural arrangement of cushioning dunnage producing mechanism for producing the pad-like dunnage product P.

The aforementioned stock roll supporting cart 18 preferably is of fabricated construction as best illustrated in FIGS. 5 through 9, and preferably embodies anti-friction means, which in the embodiment illustrated comprises wheels 77, 77*a* for facilitating the movement of the cart 18 over the surface S and into coacting connected relationship with the dunnage producing mechanism 10. The rear wheels 77*a* on the cart are preferably pivotable so as to facilitate the maneuvering of the cart into coacting relation with the dunnage producing mechanism 10.

The cart comprises upright members 78 at the forward and rearward ends of the base frame 79 of the cart with such uprights, adjacent the upper ends thereof in the embodiment illustrated, embodying receptacle structure 80 which are adapted to receive therein the respective projection or male member 16 on the dunnage producing mechanism 10, thus providing for coupling of the cart 18 to the dunnage producing mechanism, and providing for proper positioning of the stock roll 22 mounted on the cart, for feeding into the dunnage production mechanism 10.

The receptacle means 80 are preferably such size as to generally snugly receive the male coupling projection 16 on the dunnage producing mechanism 10, to thus positively position the cart with respect to the dunnage producing mechanism 10 and to more or less frictionally hold it in coacting relationship therewith. In this connection, the aforementioned elongated slots 20 on the support plate structures 14, will provide for limited sidewise adjustment of the position of the male coupling projections 16 on the dunnage producing mechanism 10, so that the projections will be in proper spaced relationship to be received accurately within the respective recess of receptacle structure 80 on the cart 18. Conventional threaded fastener means (not shown) extending through the slots 20 on each support plate structure 14, will provide for selectively fixing the position of the support plate structure with respect to the main frame 24.

Figures 4, 5, 6, 7, 8:
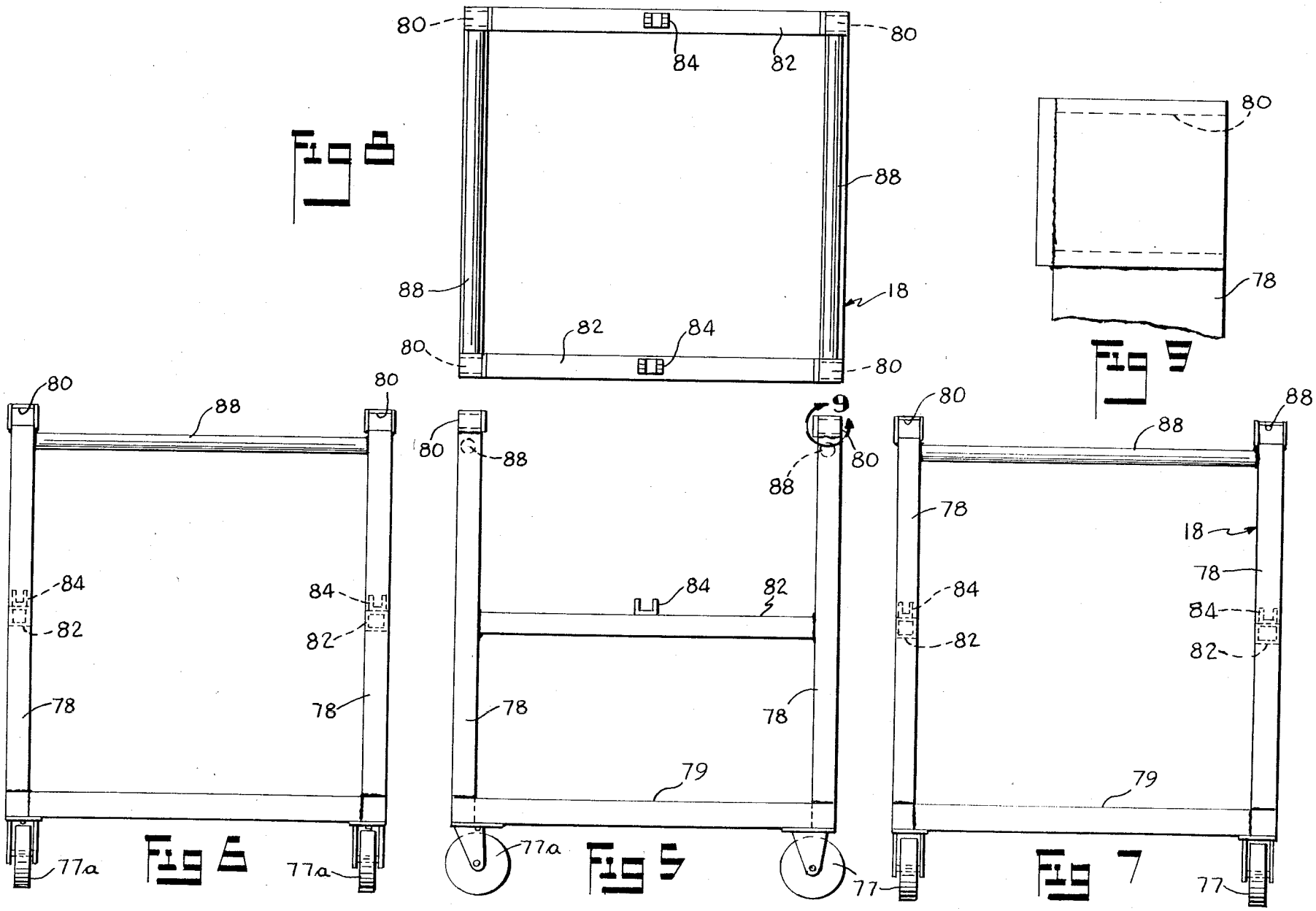
FIG. 5 is an enlarged side elevational view of the stock roll support cart of the combination assembly illustrated in FIG. 1.
FIG. 6 is an end elevational view of the stock roll support cart of FIG. 5, taken from the lefthand end thereof.
FIG. 7 is an end elevational view of the stock roll support cart of FIG. 5 taken from the righthand end thereof.
FIG. 8 is a top plan view of the stock roll support cart of FIG. 5.

Front and rear uprights 78 may be connected by means of cross bars 82 as shown in FIGS. 5, 6 and 7, with such cross bars 82 mounting thereon stock roll support brackets 84, which may be of a generally similar type as those aforedescribed and referred to by reference number 12 on the support plate structures 14. Brackets 84 are adapted to receive a rod 23 passing through the stock roll, in a generally similar manner as aforedescribed, for rotatably supporting the stock roll 22 on the cart 18.

It will be understood that the stock roll 22 can be of considerably larger size as compared to that which would be useable if such stock roll was mounted on the conventional support plate structures 14 of the dunnage producing machine, not only because of the weight of the stock roll, but also because of the desirability in positioning the stock roll directly on the dunnage machine that the outermost periphery of the stock roll does not extend beyond a horizontal longitudinal plane L passing through the lowermost point of the inner defining surface 34 of the entranceway to the chute of the dunnage machine, and as generally set forth and described in aforementioned prior art patent 4,026,198.

The stock roll support cart 18 preferably has cylindrical, in cross section, bar members 88 extending between the respective pair of front and rear uprights 78, and is secured thereto as by means of welds. The sheets of stock material which represent in the embodiment illustrated a triply arrangement of sheet stock coming off the stock roll 22, are directed upwardly about the associated rod 88 and then downwardly about the separator means elements 54 prior to passing beneath the pusher mechanism 40. The position of the sheet engaging bar 88 on the cart is preferably such that in the operative position of the cart in coacting attached relationship with respect to the dunnage producing mechanism, the bar 88 will not be disposed below the horizontal longitudinal plane passing through the lowermost point at the inner defining surface of the entranceway to the chute of the dunnage producing mechanism, thus ensuring that the initiation of movement of the stock material into the dunnage producing mechanism will not commence beyond or below such a horizontal longitudinal plane, and thus will aid in preserving the integrity of the sheet stock material, and will aid in preventing the tearing thereof.

A stock sheet engaging bar 88 is disposed on both ends of the stock roll support cart 18, and thus in the event that the cart is reversed, with the rearward end thereof receiving the projecting coupling means 16 on the dunnage producing mechanism 10 rather than the front of the cart, the sheets of stock material can likewise be moved over the sheet engaging bar 88 at that end of the cart for entry into the dunnage producing mechanism. Thus bars 88 on each end of the stock roll support cart are generally disposed in a coplanar horizontal plane. The webs of sheet stock are preferably directed from the bottom of the roll toward the associated bar 88, and as illustrated in FIG. 1. Bars 88 also serve as handles for maneuvering the cart 18 into coupled coaction with the dunnage producing mechanism.

Figure 10:
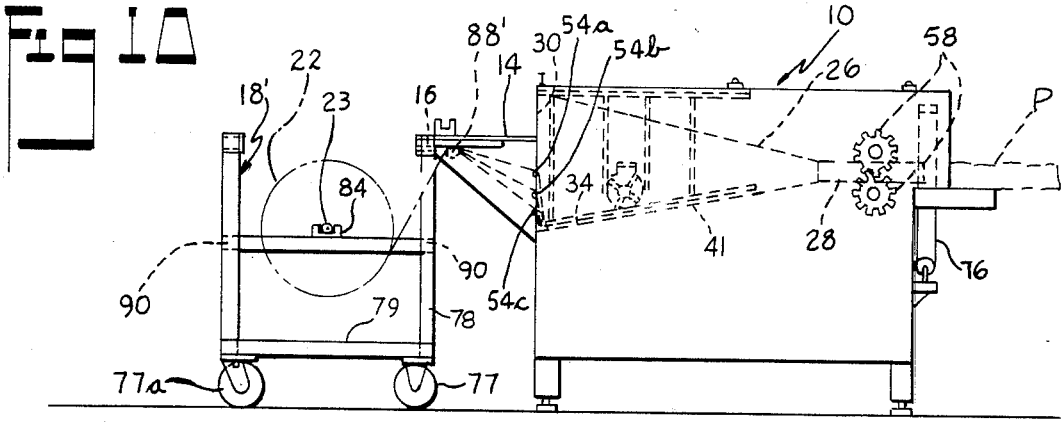
FIGS. 10 and 11 illustrate side elevational and top plan views of another embodiment of the dunnage producing mechanism and mobile stock roll support cart combination, disposed in coupled operative position.
Figure 11:
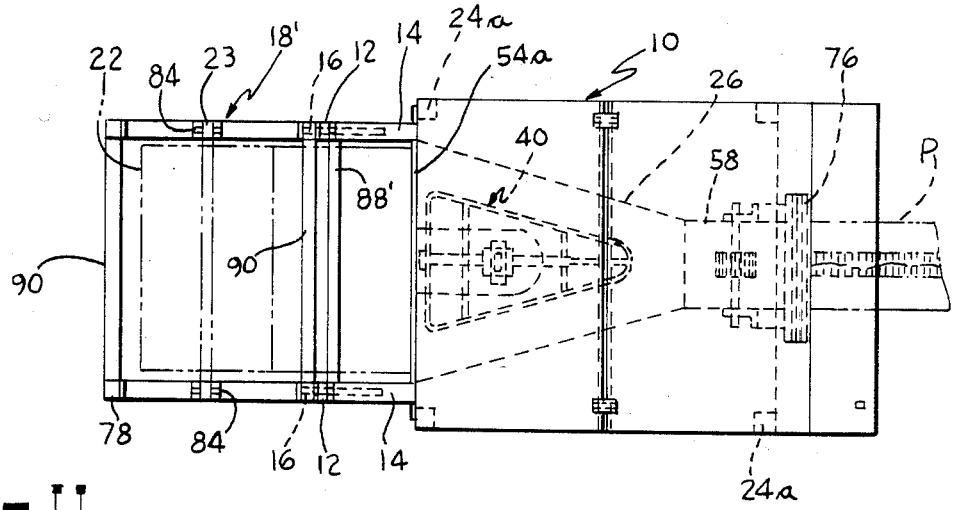

FIGS. 10 and 11 illustrate a revised embodiment wherein bar 88' over which the webs of sheet stock from stock roll 22 are adapted to pass prior to passing to the separator means 54, is disposed or supported on the structure 14, rather than being disposed on the cart 18'. Bar 88' extends between suppoat elements 14 (FIG. 11) and may be secured thereto by any suitable means, such as for instance by welds. The webs of sheet stock material from stock roll 22 preferably are taken off the bottom of the roll as illustrated in FIG. 10, and extend diagonally upwardly, to pass over preferably cylindrical bar 88'. Cart 18' may have cross struts 90 extending transversely between uprights 78 thereof. In other respects, the FIGS. 10 and 11 embodiment are generally similar to that of the first described embodiment.

From the foregoing description and accompanying drawings it will be seen that the invention provides a mechanism for producing low density pad-like cushioning dunnage from sheet-like stock material, such as for instance paper, and including a support for rotatably mounting a roll of sheet-like stock material thereon in operative position, and wherein the support has coupling means projecting therefrom adapted for coaction with coupling means on a mobile stock roll support cart, for coupling the cart to the dunnage producing mechanism, and wherein the cart has the capability of supporting thereon a larger size (and weight) of stock roll as compared to that which would ordinarily be useable with the dunnage producing mechanism per se, thus enabling a longer run of pad-like cushioning dunnage product to be produced on the mechanism without the necessity of earlier replacement of the stock roll.

The invention also provides a stock roll support cart which can be conveniently manipulated for moving into and from coaction with the dunnage producing mechanism, and wherein the stock roll thereon can be conveniently and rapidly replaced as it is used up in conjunction with the production of the pad-like cushioning dunnage product.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. In a mechanism for producing low density pad-like cushioning dunnage products from sheet-like stock material, such as for instance paper, comprising a support having means thereon adapted for rotatably mounting a multi-ply roll of sheet-like stock material in operative rotatable position on said mechanism and a stitching means downstream from said support and adapted to receive the sheet-like stock material therein and operable to connect the same into a pad-like cushioning dunnage product, said support having generally fixed coupling means thereon, and a separate mobile cart having generally fixed coupling means thereon coacting with the first mentioned coupling means, for physically connecting said cart to said mechanism, the first and second mentioned coupling means being connectable and separable by generally aligned horizontal linear movement of said cart and said second mentioned coupling means toward or away from said mechanism and said first mentioned coupling means, said cart having means thereon for rotatably mounting a stock roll of sheet-like stock material thereon for feeding into said mechanism for the production of the pad-like cushioning dunnage product, and whereby said cart is operable for supporting a larger roll of stock material in operative position for use by said mechanism as compared to the size of roll of stock material able to be mounted on said support, means on said mechanism for separating the sheets of stock material as the latter move from the roll on said cart toward said stitching means on said mechanism, and a single transversely extending sheet stock engaging means intermediate said stock roll mounting means on said cart and said separating means about which the sheet-like stock material in multi-ply form is adapted to pass prior to passing to said separating means, said stock engaging means being disposed lower than said coupling means and higher than said roll mounting means on said cart.

2. The combination in accordance with claim 1 wherein said first mentioned coupling means comprises generally linear substantially rigid projections extending laterally of said support, and said coupling means on said cart comprising receptacle structure having recesses receiving therein said projections in the coupled condition of said cart to said mechanism.

3. In a mechanism for producing low density pad-like cushioning dunnage product from sheet-like stock material, such as for instance paper, comprising a support having means thereon adapted for rotatably mounting a multi-ply roll of sheet-like stock material in operative rotatable position on said mechanism and a stitching means downstream from said support and adapted to receive the sheet-like stock material therein and operable to connect the same into a pad-like cushioning dunnage product, said support having generally fixed coupling means thereon, and a separate mobile cart having generally fixed coupling means thereon coacting with the first mentioned coupling means, for physically connecting said cart to said mechanism, the first and second mentioned coupling means being connectable and separable by generally aligned horizontal linear movement of said cart and said second mentioned coupling means toward or away from said mechanism and said first mentioned coupling means, said cart having means thereon for rotatably mounting a stock roll of sheet-like stock material thereon for feeding into said mechanism for the production of the pad-like cushioning dunnage product, and whereby said cart is operable for supporting a larger roll of stock material in operative position for use by said mechanism as compared to the size of roll of stock material able to be mounted on said support, and including means on said mechanism for separating the sheets of stock material as the latter move from the roll on said cart toward said mechanism and said stitching means thereof, and sheet stock engaging means intermediate said stock roll mounting means on said cart and said separating means, about which the sheet-like stock material moves prior to passing to said separating means, said support comprising a pair of laterally spaced plate-like members projecting in the direction of said cart, said first mentioned coupling means comprising a rigid generally linear projection mounted on the respective plate-like member and extending generally horizontally outwardly therefrom, said coupling means on said cart comprising receptacle structure having recesses receiving therein in generally snug relation the respective projection, and means for adjusting the position of said plate-like members relative to said mechanism for aiding in alignment of said coupling means.

4. The combination in accordance with claim 3 wherein said mechanism includes crumpler means adapted to receive the sheet-like stock material therein, with said crumpler means having a stock material entry opening and a stock material exit opening spaced from said entry opening, chute means disposed ahead of said crumpler means for causing inward rolling of the lateral edges of the sheet-like stock material into generally rolled-like form prior to entry of the sheet-like stock material into said crumpler means, said chute means including an entrance mouth disposed in generally confronting relation to said separating means, said chute means extending lengthwise between said crumpler means and said separating means for funneling rolled-edge stock material toward said crumpler means, said stitching means coacting with said crumpler means for connecting confronting rolled edges of the stock material together for producing the pad-like dunnage product, said stitching means including means for pulling the sheet-like stock material from the stock roll through said separating means, said chute means, and into said crumpler means, and pusher means extending into said chute means in relatively close proximity with the lower interior wall surface thereof, said pusher means being adapted to cause the sheet-like stock material to generally conform to said chute means as the stock material passes from the stock roll on said cart to said crumpler means.

5. The combination in accordance with claim 4 wherein said sheet stock engaging means is so located on said mechanism and with respect to said coupling means thereon that the sheet stock as it is being pulled from the roll mounted on said cart commences its travel from said stock engaging means toward said separating means at a location disposed so as to not extend substantially lower than a horizontal longitudinal plane passing through the lowermost point of the inner defining surface of said chute means at said entrance mouth.

6. The combination in accordance with claim 4 including cutter means disposed downstream of said crumpler means for cutting the formed pad-like dunnage product into selective lengths.

7. The combination in accordance with claim 1 wherein said cart comprises a base frame having forward and rearward ends and upright members extending upwardly from said base frame adjacent the forward and rearward ends thereof, each of said upright members having a receptacle thereon comprising the second mentioned coupling means and facing outwardly and adapted to receive in a recess therein a fixed generally linear horizontally extending projection on said mechanism when said cart is moved into generally adjacent connected condition with said mechanism, so that said fixed projection enters said recess of the respective receptacle, said projection comprising said first mentioned coupling means, said receptacles on said forward and said rearward ends providing for coupling of said cart to said mechanism from either end of said cart.

8. In a mechanism for producing low density pad-like cushioning dunnage product from sheet-like stock material, such as for instance paper, comprising a support having means thereon adapted for rotatably mounting a multi-ply roll of sheet-like stock material in operative rotatable position on said mechanism and a stitching means downstream from said support and adapted to receive the sheet-like stock material therein and operable to connect the same into a pad-like cushioning dunnage product, said support having generally fixed coupling means thereon, and a separate mobile cart having generally fixed coupling means thereon coacting with the first mentioned coupling means, for physically connecting said cart to said mechanism, the first and second mentioned coupling means being connectable and separable by generally aligned horizontal linear movement of said cart and said second mentioned coupling means toward or away from said mechanism and said first mentioned coupling means, said cart having means thereon for rotatably mounting a stock roll of sheet-like stock material thereon for feeding into said mechanism for the production of the pad-like cushioning dunnage product, and whereby said cart is operable for supporting a larger roll of stock material in operative position for use by said mechanism as compared to the size of roll of stock material able to be mounted on said support, said cart comprising a base frame having forward and rearward ends and upright members extending upwardly from said base frame adjacent the forward and rearward ends thereof, each of said upright members having a receptacle thereon comprising the second mentioned coupling means and facing outwardly and adapted to receive in a recess therein a fixed generally linear horizontally extending projection on said mechanism when said cart is moved into generally adjacent connected condition with said mechanism, so that said fixed projection enters said recess of the respective receptacle, said projection comprising said first mentioned coupling means, said receptacles on said forward and said rearward ends providing for coupling of said cart to said mechanism from either end of said cart, and wherein said upright members have connecting members extending therebetween, and means comprising said stock roll mounting means on said cart mounted on said connecting members for rotatably mounting a stock roll of sheet material thereon, sheet stock engaging means on said cart about which the sheet-like stock material is adapted to move prior to passing to said mechanism, said sheet stock engaging means comprising a generally rigid bar disposed on said uprights and extending transversely therebetween at both said forward and said rearward ends, said bar at each of said ends being disposed below said coupling means and higher than said roll mounting means on said cart.

9. In a mechanism for producing low density pad-like cushioning dunnage product from sheet-like stock material, such as for instance paper, comprising a support having means thereon adapted for rotatably mounting a multi-ply roll of sheet-like stock material in operative rotatable position on said mechanism and a stitching means downstream from said support and adapted to receive the sheet-like stock material therein and operable to connect the same into a pad-like cushioning dunnage product, said support having generally fixed coupling means thereon, and a separate mobile cart having generally fixed coupling means thereon coacting with the first mentioned coupling means for physically connecting said cart to said mechanism, the first and second mentioned coupling means being connectable and separable by generally aligned horizontal linear movement of said cart and said second mentioned coupling means toward or away from said mechanism and said first mentioned coupling means, said cart having means thereon for rotatably mounting a stock roll of sheet-like stock material thereon for feeding into said mechanism for the production of the pad-like cushioning dunnage product, and whereby said cart is operable for supporting a larger roll of stock material in operative position for use by said mechanism as compared to the size of roll of stock material able to be mounted on said support, and wherein said cart has forward and rearward ends, and adjacent each end thereof includes transversely extending bar means providing a handle for moving said cart, by a workman, said bar means also providing sheet stock engaging means and being adapted to slidingly engage with the sheet stock material from the stock roll prior to its movement into said mechanism, said second mentioned coupling means being located on both ends of said cart and providing for said connecting of said cart to said mechanism from either end of said cart, said bar means being disposed lower than said coupling means and higher than said roll mounting means on said cart.

10. The combination in accordance with claim 9 wherein said cart is fabricated with the parts being formed from conventional metal tubular stock and welded together.

11. In a mechanism for producing low density pad-like cushioning dunnage product from sheet-like stock material, such as for instance paper, comprising a support having means thereon adapted for rotatably mounting a multi-ply roll of sheet-like stock material in operative rotatable position on said mechanism and a stitching means downstream from said support and adapted to receive the sheet-like stock material therein and operable to connect the same into a pad-like cushioning dunnage product, said support having generally fixed coupling means thereon, and a separate mobile cart having generally fixed coupling means thereon coacting with the first mentioned coupling means, for physically connecting said cart to said mechanism, the first and second mentioned coupling means being connectable and separable by generally aligned horizontal linear movement of said cart and said second mentioned coupling means toward or away from said mechanism and said first mentioned coupling means, said cart having means thereon for rotatably mounting a stock roll of sheet-like stock material thereon for feeding into said mechanism for the production of the pad-like cushioning dunnage product, and whereby said cart is operable for supporting a larger roll of stock material in operative position for use by said mechanism as compared to the size of roll of stock material able to be mounted on said support, and wherein said first mentioned coupling means comprises generally linear substantially rigid projections extending laterally of said support, and said coupling means on said cart comprising receptacle structure having recesses receiving therein said projections in the coupled condition of said cart to said mechanism, and wherein said mechanism comprises a frame, said support comprising a pair of generally vertically oriented laterally spaced plate-like members mounted in cantilevered relation to said frame adjacent the entranceway to said mechanism, each of said plate-like members having one of said projections mounted thereon and extending therefrom in the direction of said cart, and means on each of said plate-like members for adjusting the position of said projections in a direction transversely of said mechanism for aiding in alignment of said projections with the respective recesses in said receptacle structure of said cart.

12. In a mechanism for producing low density pad-like cushioning dunnage product from sheet-like stock material, such as for instance paper, in multi-ply roll form, said mechanism comprising a frame, a stitching means on said frame adapted to receive the sheet-like stock material therein and operable to connect the same into a pad-like cushioning dunnage product, a longitudinally converging chute means mounted on said frame upstream from said stitching means and including a widened entrance mouth portion, and operable for causing inward rolling of the lateral edges of the sheet-like stock material into generally rolled-like form prior to entry of the sheet-like stock material into said stitching means, said mechanism including fixed coupling means thereon projecting laterally of said mouth portion, and a separate mobile cart having forward and rearward ends and having fixed coupling means thereon at said forward end coacting with the first mentioned coupling means, for physically connecting said cart to said mechanism, said first mentioned couppling means projecting laterally of said mouth portion in the direction of said cart, and the first and second mentioned coupling means being connectable and separable solely by generally aligned horizontal linear movement of said cart and said second mentioned coupling means toward or away from said mechanism and said first mentioned coupling means, said cart having means thereon for rotatably mounting a stock roll of multi-ply sheet-like stock material thereon for feeding into said mechanism for the production of the pad-like cushioning dunnage product, separating means on said mechanism upstream from said mouth portion for separating the sheets of stock material as the latter move from the roll on said cart toward said mechanism and said mouth portion, and a single means extending tranverse relative to said mechanism and said cart and coacting with said roll mounting means, about which the sheet-like stock material from the roll on said cart is adapted to pass in multi-ply form prior to passing into said separating means whereby the location in said mechanism of commencement of entry of the sheet-like stock material toward said separating means remains constant irrespective of the diameter of the stock roll, said transverse extending means being disposed lower than said first and said second mentioned coupling means and higher than said roll mounting means on said cart and said separating means on said mechanism, said stitching means being operable to pull the sheet-like stock material from the stock roll about said transverse extending means, and then through said separating means and said chute means.

* * * * *